US009231297B2

(12) United States Patent
Clement et al.

(10) Patent No.: US 9,231,297 B2
(45) Date of Patent: Jan. 5, 2016

(54) BROADBAND HF ANTENNA FULLY INTEGRATED ON A NAVAL SHIP

(75) Inventors: Maarten Clement, Schiedam (NL); Jan Martinus Schouten, Lisse (NL)

(73) Assignee: THALES NEDERLAND B.V., Hengelo (NL)

( * ) Notice: Subject to any disclaimer, the term of this patent is extended or adjusted under 35 U.S.C. 154(b) by 144 days.

(21) Appl. No.: 13/384,830

(22) PCT Filed: Jul. 23, 2010

(86) PCT No.: PCT/EP2010/060711

§ 371 (c)(1),
(2), (4) Date: Apr. 27, 2012

(87) PCT Pub. No.: WO2011/009940

PCT Pub. Date: Jan. 27, 2011

(65) Prior Publication Data

US 2012/0212379 A1 Aug. 23, 2012

(30) Foreign Application Priority Data

Jul. 23, 2009 (EP) ..... 09166285

(51) Int. Cl.

| | |
|---|---|
| ***H01Q 1/34*** | (2006.01) |
| ***H01Q 9/42*** | (2006.01) |
| ***H01Q 5/00*** | (2015.01) |
| ***H01Q 5/335*** | (2015.01) |
| ***H01Q 5/50*** | (2015.01) |

(52) U.S. Cl.

CPC ..... *H01Q 1/34* (2013.01); *H01Q 5/335* (2015.01); *H01Q 5/50* (2015.01); *H01Q 9/42* (2013.01)

(58) Field of Classification Search

CPC ..... H01Q 1/34
USPC ..... 343/702, 710, 712
See application file for complete search history.

(56) References Cited

U.S. PATENT DOCUMENTS 5,014,068 A 5/1991 Abramo
5,489,911 A * 2/1996 Gordon et al. ..... 343/709

FOREIGN PATENT DOCUMENTS

WO 2006134543 12/2006

OTHER PUBLICATIONS

International Preliminary Report on Patentability dated Jan. 24, 2012 in Application No. PCT/EP2010/060711.
Written Opinion dated Jan. 23, 2012 in Application No. PCT/EP2010/060711.
International Search Report for PCT/EP2010/060711 dated Oct. 6, 2010.
"Naval Strutural Antenna Systems For Broadband HF Communications—Part II: Design Methodology for Real Naval Platforms", Gaetano Marrocco, IEEE Transactions on Atennas and Propagation, vol. 54, No. 11, Nov. 2006.

* cited by examiner

*Primary Examiner* — Robert Karacsony
*Assistant Examiner* — Daniel J Munoz
(74) *Attorney, Agent, or Firm* — Snell & Wilmer L.L.P.

(57) ABSTRACT

There is disclosed a broadband HF antenna, which is fully integrated on a naval ship. This antenna enables to transmit and/or receive radio-frequency waves from a naval ship. The antenna comprises a radiating element and an exciting element. The exciting element excites the radiating element when fed with current. The radiating element is a structural element of the ship itself.

14 Claims, 5 Drawing Sheets

BROADBAND HF ANTENNA FULLY INTEGRATED ON A NAVAL SHIP

CROSS-REFERENCE TO RELATED APPLICATIONS

This application is a U.S. national phase filing under 35 U.S.C. §371 of PCT/EP2010/060711 filed Jul. 23, 2010 and is incorporated herein by reference.

FIELD

The present invention relates to a broadband high frequency antenna, which is fully integrated on a naval ship. For example, the invention is particularily applicable to navy shipbuilding in connection with antenna integration.

A highly efficient broadband antenna is realised by intentional and controled excitation of resonance currents in an enlarged state-of-the-art mast, a funnel or another large metal structure on the ship.

In principle, the broadband behaviour of the antenna enables the simultaneaous transmission at an unlimited number of communication lines using one single high-power amplifier.

BACKGROUND

Existing shipboard High Frequency (HF) transmit antennas, i.e. antennas transmitting waves between 1 and 30 MHz, cause major problems for proper mechanical integration on the ship. These problems are mainly due to the large extension of the antennas, which result in mechanical obstruction of on-board sensors and/or weapon systems. The height of these antennas also increases the risk of lightning strike. These problems are also related to high electromagnetic field strengths in the neighbourhood of the antennas, thus increasing the risk of radiation hazards to people and electromagnetic interferences (EMI) to other equipments. Moreover, the transmission efficiency is not optimal in a large part of the HF band due to a too low or too high antenna impedance. In addition, these problems are also related to high maintenance costs.

A conventional solution for providing a shipboard HF transmit antenna, consists in using a whip antenna, which is the most common example of a monopole antenna. Unfortunately, a whip antenna has many disadvantages. First, a shipboard HF transmit whip antenna is long, typically 10 meters. Furthermore, for a given frequency channel in the band, a whip antenna requires a tuning unit for proper impedance matching between the antenna itself, the generator and to the coax feed cable. Consequently, only one communication line can be used per whip antenna. When more communication lines are required, several 10 meters long whip antennas have to be arranged on the ship. This considerably increases the risk of EMI and radiation hazards. This also result in blocking of other equipment, which often causes serious performance degradation of shipboard radars and other sensors. In addition, the efficiency of such monopole antennas is low in a large part of the HF band.

Another conventional solution for providing a shipboard HF transmit antenna, consists in using towel bar antennas. Towel bar antennas are commonly used for so-called 'Nearly Vertical Incident Skywave' (NVIS) communication, which requires a high antenna gain at high elevation angles. Unfortunately, towel bar antennas have many disadvantages. First, towel bar antennas are not suitable for omnidirectional transmission at low elevation. Just as for the whip antenna, a tuning unit is required for impedance matching. Consequently, only one communication line can be used per towel bar antenna. When more communication lines are required, several towel bar antennas have to be arranged on the ship, thus increasing the risk of EMI and radiation hazards. In addition, the efficiency is low in a large part of HF band.

Yet another conventional solution for providing a shipboard HF transmit antenna, consists in using fan wire antennas. Fan wire antennas are commonly used for broadband transmissions. Even if the efficiency remains low in a large part of HF band, it is generally better in the lower part of the HF band than with whip or towel bar antennas. Unfortunately, fan wire antennas have many disadvantages. First, a fan wire antenna has to be quite large to optimise its efficiency in the lower part of the HF band. As a consequence, it generally has an extension above a large part of the ship, hereby dramatically blocking other equipments or leading to high risks of EMI.

In an attempt to overcome the aforementioned disadvantages, non-conventional concepts for HF antennas have been described, namely compact HF antennas and fractal antennas.

Compact HF antennas are antennas, of which length is less than a quarter the wavelength. For example, the spiral antenna, the magnetic loop antenna, the ExH antenna, the Crossed Field Antenna (CFA) or the Isotron antenna are compact HF antennas. Other examples are the helical whip antenna, the doublet antenna, as well as any small dipole or loaded dipole. Also for radio broadcast in the LF and MF bands, compact or so called 'shortened' antennas are used in some cases. Unfortunately, a compact HF antenna has also many disadvantages. In principle, the radiation efficiency of a compact HF antenna is extremely low, except for a very narrow frequency band. For this reason, compact HF antenna are often designed to be used in a fixed and quite narrow frequency band, even when it is labelled as a 'broadband' antenna. When a compact antenna is used for broadband transmission, it is accepted that the antenna efficiency is quite low.

Several types of compact antennas can be tuned, however the tuning of a compact HF antenna is critical, due to the extremely narrow bandwidth. The radiation efficiency remains still low, due to a bad matching of the real part of the impedance. Consequently, when more communication lines are required, several compact HF antennas have to be arranged on the ship, thus increasing the risks of EMI and radiation hazards.

Fractal antennas are a relatively compact type of antenna. Recently, it has been introduced a fractal antenna for naval HF communications. Unfortunately, a fractal antenna has also many disadvantages. Just as for the conventional and the compact HF antennas, the efficiency of fractal antennas is low in a large part of HF band due to a too low or too high real part of the impedance. Furthermore, just as for the monopole antenna, for a given frequency channel in the band, a tuning unit is required for proper impedance matching between the antenna itself, the generator and possibly to a coax feed cable. Consequently, only one communication line can be used per antenna. When more communication lines are required, several antennas have to be arranged on the ship, thus increasing the risk of EMI, radiation hazards and blocking of other equipment.

In an attempt to provide an HF antenna allowing easy mechanical integration on a naval ship, G. Marrocco and L. Mattioni recently described a naval structural HF antenna in their paper titled 'Naval Structural Antenna Systems for Broadband HF Communications' (IEEE transactions on antennas and propagation, vol 54, NO. 4, April 2006). The antenna described in this paper consists basically in a set of long vertical metal rods or wires, the set being so called "subradiator", connected to the top of kind of an enlarged state-of-the-art mast or a large funnel. According to the authors, the principle of the structural antenna they describe is that of a folded monopole, where the subradiator is the radiating element and where the enlarged mast or the funnel acts only as a thick return wire. That is the reason why the subradiator must, in principle, be more than a quarter the wavelength to achieve reasonable efficiency. The performances of the described structural antenna are then optimised by forming an extra nested loop at the top of the subradiator and by arranging a set of impedance loads along the rods or wires. Unfortunatley, such an antenna still gives mediocre possibilities for integration. Indeed, a plurality of large subradiators are needed to achieve reasonable performances, since the described subradiators are typically 12 meters long. The large extension of the subradiators results in blocking or reflection of waves from and to other equipments, thus seriously degrading performances at a system level. The large extension of the subradiators also results in increasing the risk of EMI and radiation hazards. The use of subradiators peaking more than 12 meters high also increases the risks of lightning strike in the HF antenna. Moreover, even if the antenna offers the possibility for simultaneous transmissions, the number of frequency channels remains limited by the number of subradiators arranged around the enlarged mast or the funnel of the ship. Furthermore, each subradiator has to be connected to a separate power generator and tuning unit, which increase the amount of required equipment, the number of cables and thus also the complexity of the system integration.

SUMMARY

The present invention aims to provide a broadband HF antenna with optimized integration possibilities on a naval ship. To this aim, the invention proposes a naval structural antenna, of which the main radiating element is a large structural element of the ship itself. Hereby, the antenna is fully integrated on the ship. At its most general, the invention proposes an antenna to transmit and/or receive radio-frequency waves from a naval ship. The antenna comprises a radiating element and an exciting element connected to the radiating element, which excites the radiating element when fed with current. The radiating element is a structural element of the ship.

Advantageously, the radiating structural element may be a metal structure raising above the deck of the ship. For example, the metal structure may be an enlarged mast or a funnel or a deckhouse, so that the antenna transmits and/or receives in the Medium Frequency (MF) band or in the High Frequency (HF) band or in the Very High Frequency (VHF) band.

Advantageously, the exciting element may be a linear element extending in a single dimension, so as to reduce the overall dimensions of the antenna. For example, the exciting element may be a rod or a pipe or a wire, which may be connected at one end to the radiating structural element and at the other end to the deck of the ship.

In a preferred embodiment, the exciting element may comprise a plurality of parallel linear elements defining parallel current paths. For example, the parallel linear elements may be rods or pipes or wires.

Advantageously, the exciting element may also be connected at one end to the radiating structural element and at the other end to another structural element of the ship, which may be of smaller dimensions than the radiating structural element. All or a few of the parallel linear elements may be connected to the radiating structural element and/or to the other structural element of the ship via separate connection points.

Preferably, at least one impedance load may be arranged along the exciting element. For example, the impedance load may comprise a capacitor and/or a coil and/or a resistor.

Preferably, a current feed may be arranged along the exciting element. The current feed may be adapted to be connected to a generator or a coaxial cable.

The antenna may be adapted at the current feed to realise proper impedance matching between the antenna, a generator and/or a coaxial cable.

Thus, an advantage provided by the present invention in any of its aspects is that it provides optimal broadband performances in the used frequency band. Moreover, it allows simultaneous transmissions on multiple channels. The number of communication lines is not limited by the antenna.

Furthermore, when the different communication signals are combined at low power, only one high-power amplifier is required, which reduces the costs, weight, volume and power consumption of equipment.

BRIEF DESCRIPTION OF THE DRAWINGS

Non-limiting examples of the invention are described below with reference to the accompanying drawings in which.

DESCRIPTION OF THE VARIOUS EMBODIMENTS

In the figures, like reference signs are assigned to like items.

Figure 1:
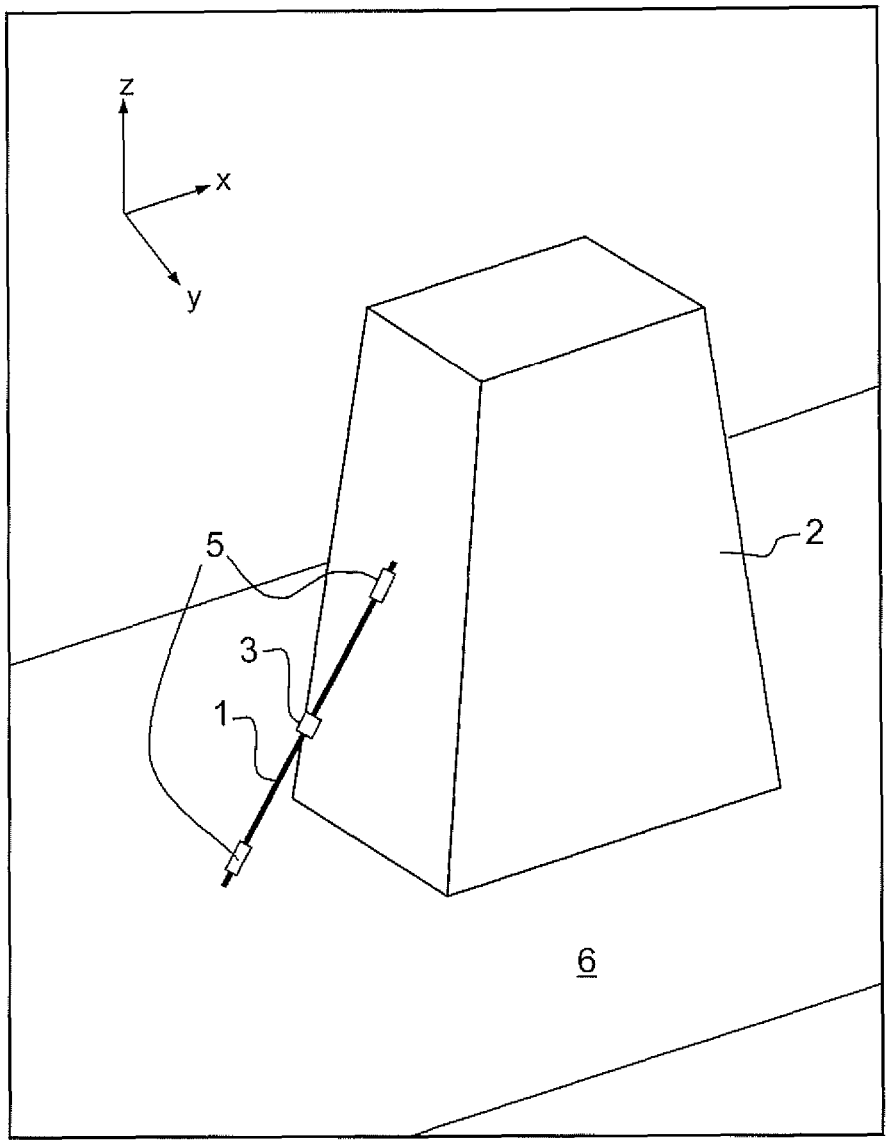
FIG. 1 schematically illustrates an exemplary structural antenna according to the invention, FIG. 2, schematically illustrates an exemplary arrangement for combining lines at low power and for amplifying the combined lines, FIG. 3, schematically illustrates another exemplary structural antenna according to the invention.

FIG. 1 schematically illustrates an exemplary structural broadband HF antenna according to the invention. The exemplary antenna comprises an exciting element 1 connected to an enlarged state-of-the-art mast 2. In the present application, an "enlarged mast" is a naval ship mast, of which dimensions allows for integration of lots of sensors and other bulky equipments inside. In particular, "enlarged masts" in the sense of the present application are not to be mistaken with old-fashioned mast, which are constructions built-up of a network of narrow pipes. The exemplary enlarged mast 2 stands on a deck 6 of a naval ship. However, any other large metal structural element arranged on the deck 6 may be used instead of the enlarged mast 2, such as a funnel or a deckhouse for example. In the present example, the enlarged mast 2 has a typical height of 8 meters and a typical base cross-section of around 4 meters. Thus, the exciting element 1 has reduced dimensions compared to the enlarged mast 2. Hereby, to prevent blocking of sensors arranged inside the enlarged mast 2, for example phased array radars, the first connection point between the exciting element 1 and the enlarged mast 2 may be located at a relatively low height, i.e. around 3 meters above the deck 6. In the present embodiment, the exciting element 1 may also be connected to the deck 6 at a second connection point located at a distance of around 3.5 meters from the enlarged mast 2. The exciting element 1 has also reduced dimensions compared to the wavelengths in the HF band. According to the invention, the enlarged mast 2 is the main radiating element, while the element 1 is only an exciting element, which excites the enlarged mast 2 when fed with current by virtue of a feed 3. Furthermore, the use of an enlarged mast as radiating element improves the omnidirectional radiation characteristics of the antenna. Preferably, the exciting element 1 may be a metal rod. However, any other metal linear element may be used instead of a rod, such as a wire or a pipe for example. The setup of FIG. 1 advantageously provides a compact broadband HF antenna, which is particularly efficient from 5 MHz to 30 MHz. Moreover, it can be used for broadband transmissions, i.e. it can transmit simultaneously on multiple frequency channels. To achieve such a broadband behaviour, the real part of the antenna impedance may be kept within certain limits in the used frequency band, while the imaginary part of the impedance may be be minimised, the lower bound of the frequency band being determined by the height of the enlarged mast 2. Advantageously, the control of the real part of the antenna impedance may be achieved by application of one or more impedance loads 5 arranged at proper positions along the exciting element 1. Preferably, each of the impedance loads 5 may comprise a network of coils and/or capacitors as well as resistors. Optionally, a transformer or a transistor may be arranged at the feed 3 to adapt the real part of the antenna impedance to the impedance of the generator and possibly also to a coax cable that may be plugged in the feed 3. Preferably, the imaginary part of the antenna impedance may be compensated by use of a so-called "matching load" at the feed 3. For broadband applications, the matching load may then comprise a network that approximately compensates the imaginary part of the antenna impedance over the used frequency band. Alternatively, the antenna matching may also be achieved by arranging proper impedance loads inside the exciting element 1.

Figure 2:
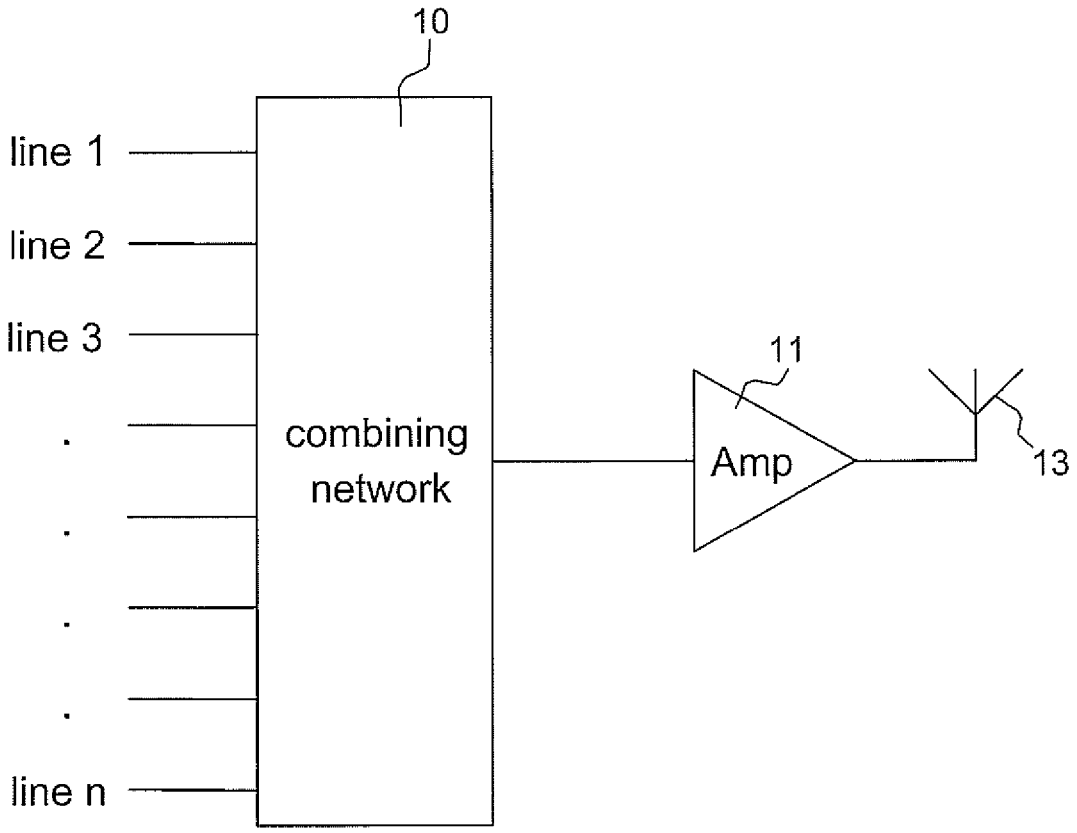

FIG. 2 schematically illustrates an exemplary arrangement for combining different communication input lines 1, 2, . . . , n at low power and for amplifying the combined lines. A combiner network 10 combines the lines 1, 2, . . . , n at low power, i.e. before they are amplified. Next a broadband linear amplifier 11 amplifies the combined signal and directs the combined signal to an antenna 13. For example, the antenna 13 may be the antenna according to the invention illustrated by FIG. 1. The use of the low power combiner network 10 results in a lower power consumption and a lower heat dissipation. Hereby, it makes easier combining a larger number of lines. This also allows to use a single front-end for a large number of lines. The combiner network 10 may be a single combiner or a series of combiners. Eventually a circulator may be arranged to protect the amplifier 11 against reflected waves.

Figure 3:
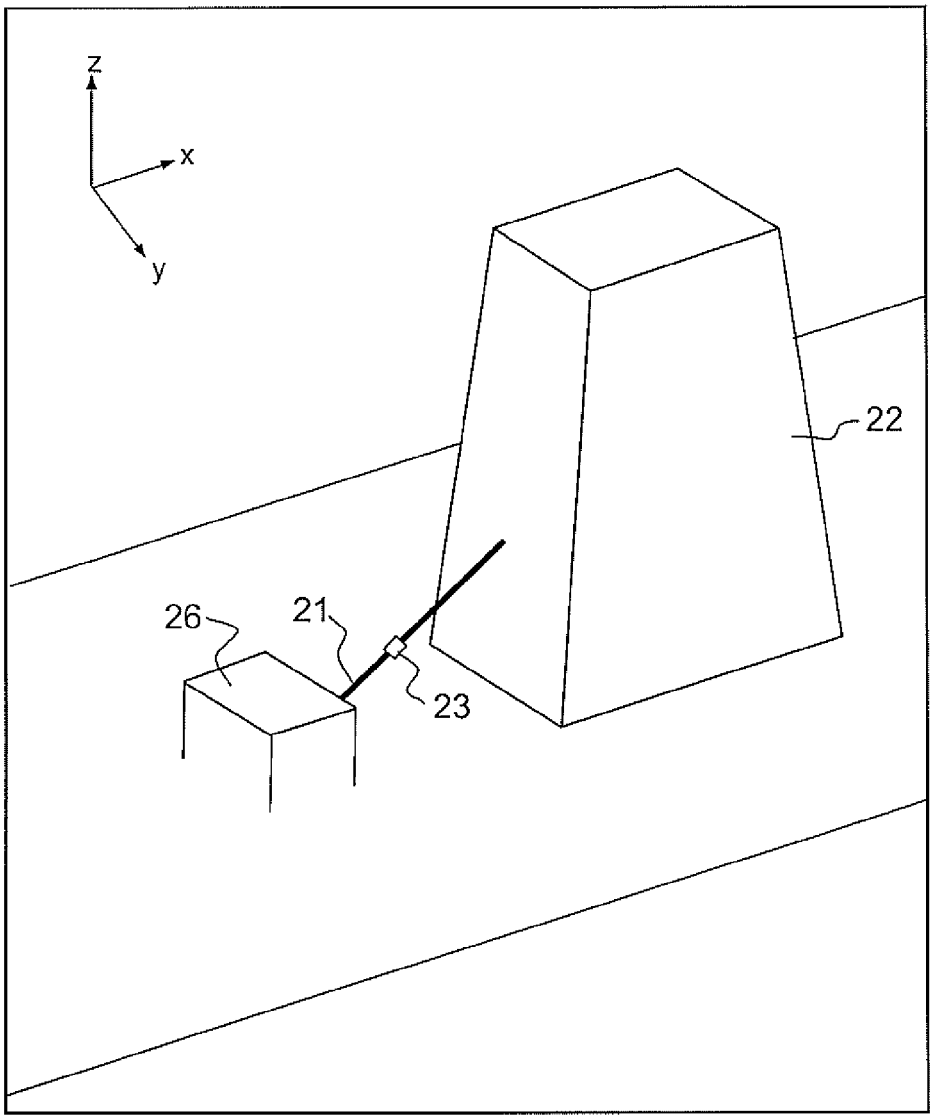

FIG. 3 schematically illustrates another exemplary structural broadband HF antenna according to the invention, comprising an exciting element 21 with a feed 23. In the present embodiment, the exciting element 21 may be a rod connected at one end to an enlarged mast 22 and at the other end to a deckhouse 26. However, any other metal structural element of the ship, which may be of smaller dimensions than the enlarged mast 22, such as a funnel for example, may be convenient instead of the deckhouse 26.

Figure 4:
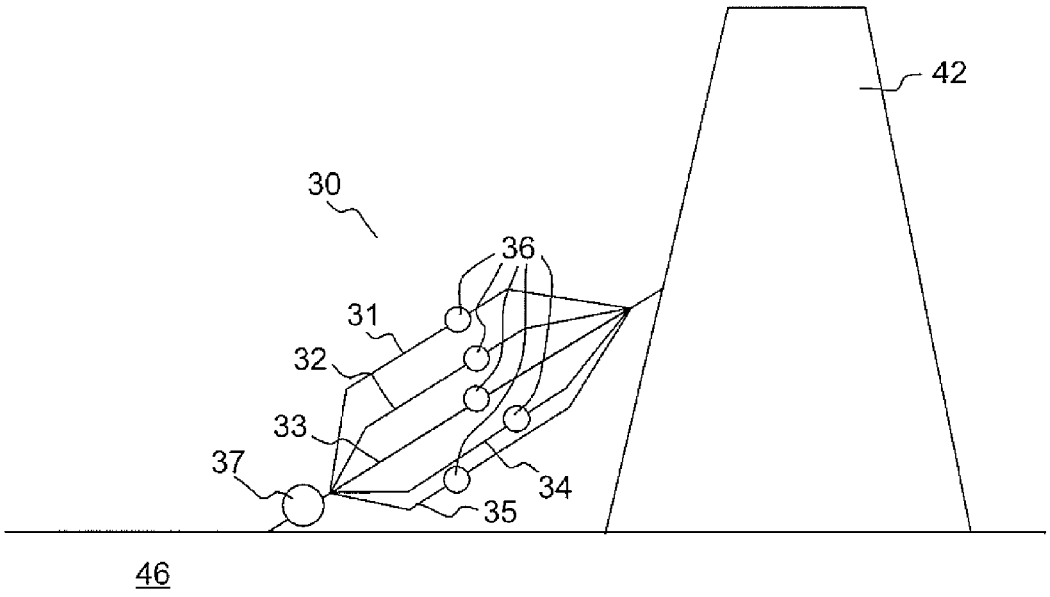
FIG. 4, schematically illustrates yet another exemplary structural antenna according to the invention.

FIG. 4 schematically illustrates yet another exemplary structural broadband HF antenna according to the invention. An exciting element 30 may be connected at one end to an enlarged mast 42 of a ship and at the other end to a deck 46 of the ship. However, the exciting element 30 may also be connected at one end to the enlarged mast 42 and at the other end to any metal structural element of the ship, which may be of smaller dimensions than the enlarged mast 42. The exciting element 30 may comprise, in its middle part, a plurality of parallel rods 31, 32, 33, 34, 35. In an other embodiment, all or a few of the parallel rods 31, 32, 33, 34, 35 may also be connected directly to the enlarged mast 42 and/or to the deck 46 the ship, via separate connection points. Impedance loads 36 may be arranged along the rods 31, 32, 33, 34, 35. Advantageously, the parallel rods 31, 32, 33, 34, 35 may define a set of parallel current paths between the enlarged mast 42 and the ship. The antenna performance may be even further optimised by use of these parallel guiding elements, as it may be possible to improve the efficiency in a given frequency band or to extend the operational band of the antenna. For example, in the lower part of the HF band, an improved antenna performance may be realised so that in principle the whole HF band from 1 to 30 MHz may be covered. Any other metal linear elements may be used instead of rods, such as wires or pipes for example. The exciting element 30 may also comprise a current feed 37.

Figure 5:
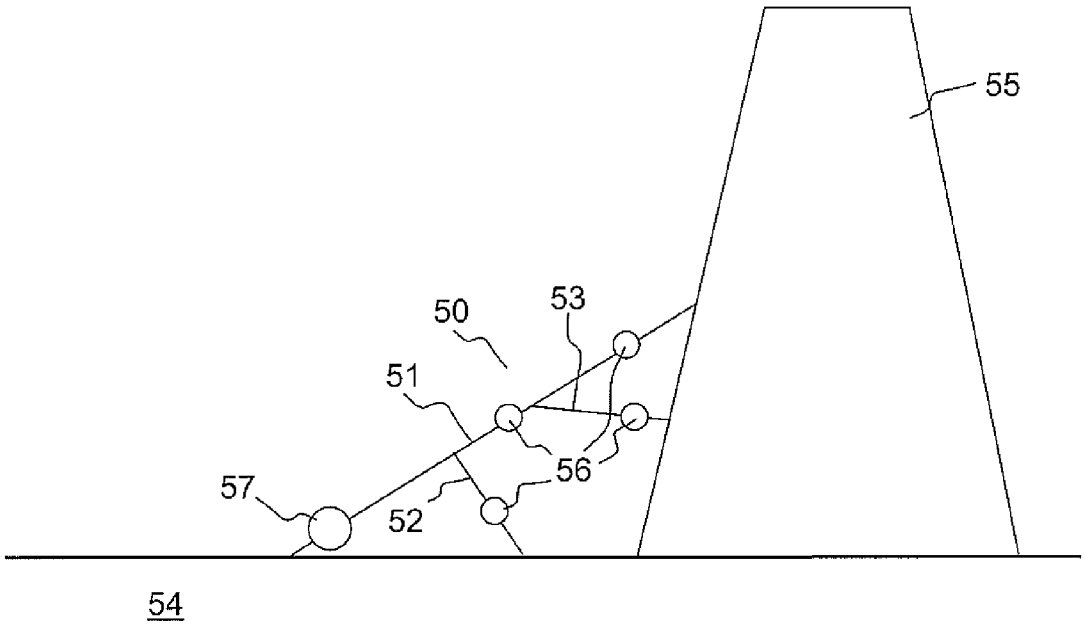
FIG. 5, schematically illustrates yet another exemplary structural broadband HF antenna according to the invention.

FIG. 5 schematically illustrates yet another exemplary structural broadband HF antenna according to the invention. Non-parallel linear elements 51, 52 and 53, for example rods, pipes ore wires, may also be connected to an enlarged mast 55 and to a deck 54 of a naval ship, via separate connection points. Impedance loads 56 may be arranged along the linear elements, as well as a current feed 57.

It is worth noting that, in principle, any antenna according to the invention may also be used for receive. Onboard of a navy ship, it may also be used as antenna for the so-called 'tactical VHF' band (30 MHz-88 MHz), if connected to an enlarged mast or a funnel or a pedestal with a height of approximately 2.5 m. Onboard aircraft carriers, it may be used in LF, MF and HF band, if connected to the mast or a large deckhouse. It may also be used onboard a civil ship in the HF and VHF bands.

For many reasons, an HF antenna according to the invention is easier to integrate on a naval ship than existing antennas. Basically, the reduced dimensions of its exciting element make straightforward the mechanical integration. In particular, blocking of other sensors can easily be prevented. The regions with high local electromagnetic fields are limited due to the less aerial extension of the exciting element. The risk of lightning strike is reduced due to the compact size and shape of the exciting element. Also, the isolation between phased array antennas does not suffer from the vicinity of the exciting element.

The invention claimed is:

1. An antenna to transmit and/or receive radio-frequency waves from a naval ship comprising a deck, wherein the antenna comprises:

a radiating element formed by a structural element of the ship arranged on the deck of the ship, said structural element having a given height and a given base cross-section, and an exciting element, having a smaller height than said structural element, for exciting said radiating element when said exciting element is fed with current, said exciting element being fed by a unique feed and comprising at least one tilted metal linear element connected, at a first end, to said radiating element and, at a second end, to an element arranged on the deck of the ship, wherein said first end is positioned below the median point of said structural element.

2. The antenna as claimed in claim 1, wherein the structural element is an enlarged mast or a funnel or a deckhouse, so that the antenna transmits and/or receives in the Medium Frequency band or in the High Frequency band or in the Very High Frequency band.

3. The antenna as claimed in claim 1, wherein the exciting element extends in a single dimension, so as to reduce the overall dimensions of the antenna.

4. The antenna as claimed in claim 1, wherein the exciting element comprises a plurality of parallel metal linear elements connected at each end to said at least one metal linear element, the parallel linear elements defining parallel current paths.

5. The antenna as claimed in claim 1, wherein each metal linear element of said exciting element is chosen among a group consisting of rods, pipes and wires.

6. The antenna as claimed in claim 1, wherein said element arranged on the deck of the ship is of smaller dimensions than the radiating structural element.

7. The antenna as claimed in claim 1, wherein at least one impedance load is arranged along the exciting element.

8. The antenna as claimed in claim 7, wherein the impedance load comprises at least one element among the group consisting of a capacitor, a coil and a resistor.

9. The antenna as claimed in claim 3, wherein a current feed is arranged along the exciting element.

10. The antenna as claimed in claim 9, adapted at the current feed to realize proper impedance matching between at least two elements among the group consisting of the antenna, a generator and a coaxial cable.

11. The antenna as claimed in claim 1, wherein the exciting element comprises a plurality of metal linear elements parallel to said at least one metal linear element, each parallel linear element being connected via separate connection points to said radiating element and/or to an element arranged on the deck of the ship, said plurality of parallel linear elements defining parallel current paths.

12. The antenna as claimed in claim 7, wherein at least one impedance load is arranged along each metal linear element.

13. The antenna as claimed in claim 1, wherein the exciting element comprises a plurality of non-parallel linear elements connected, at one end to said at least one metal linear element, and at the other end to the radiating element or to an element arranged on the deck of the ship.

14. The antenna of claim 1, wherein the height exciting element is strictly inferior to 8% of the maximum wavelength of the High Frequency band.

* * * * *